United States Patent [19]

Hankel

[11] Patent Number: 4,525,207

[45] Date of Patent: Jun. 25, 1985

[54] PROCESS OF PRODUCING BRIQUETTES TO BE CHARGED TO ZINC-PRODUCING SHAFT FURNACES

[75] Inventor: Dirk Hankel, Mühlheim, Fed. Rep. of Germany

[73] Assignee: Metallgesellschaft Aktiengesellschaft, Frankfurt am Main, Fed. Rep. of Germany

[21] Appl. No.: 570,481

[22] Filed: Jan. 13, 1984

Related U.S. Application Data

[63] Continuation of Ser. No. 339,583, Jan. 15, 1982.

[30] Foreign Application Priority Data

Jan. 22, 1981 [DE] Fed. Rep. of Germany ..... 3101886

[51] Int. Cl.[3] ..... B22F 1/02

[52] U.S. Cl. ..... 75/3; 75/7; 75/9; 75/77

[58] Field of Search ..... 75/3, 9, 7, 77

[56] References Cited

U.S. PATENT DOCUMENTS 3,523,786 8/1970 Loosemore et al. ..... 75/87

3,946,098 3/1976 Harris ..... 264/117

4,231,791 11/1980 Charles ..... 75/3

4,274,878 6/1981 Charles ..... 75/3

OTHER PUBLICATIONS

Morgan & Lumsden, "Zinc-Blast Furnace Operation", Journal of Metals (1959).

*Primary Examiner*—Peter D. Rosenberg

*Attorney, Agent, or Firm*—Sprung Horn Kramer & Woods

[57] ABSTRACT

Calcine which has been obtained by roasting in a fluidized bed and contains zinc oxide is briquetted at elevated temperatures. To produce briquettes having desirable properties for processing in a zinc-producing shaft furnace, the calcine is provided with metallic lead and/or lead oxide in an amount corresponding to at least 3% lead, non-caking coal having a low content of volatile constituents is admixed to the calcine, the Pb:C weight ratio is adjusted to at least 1, and the mixture is briquetted at a compacting temperature of 250° to 470° C. and under an applied pressure amounting to 4 to 20 metric tons per centimeter or roll width when said pressure is dynamically measured.

7 Claims, 1 Drawing Figure

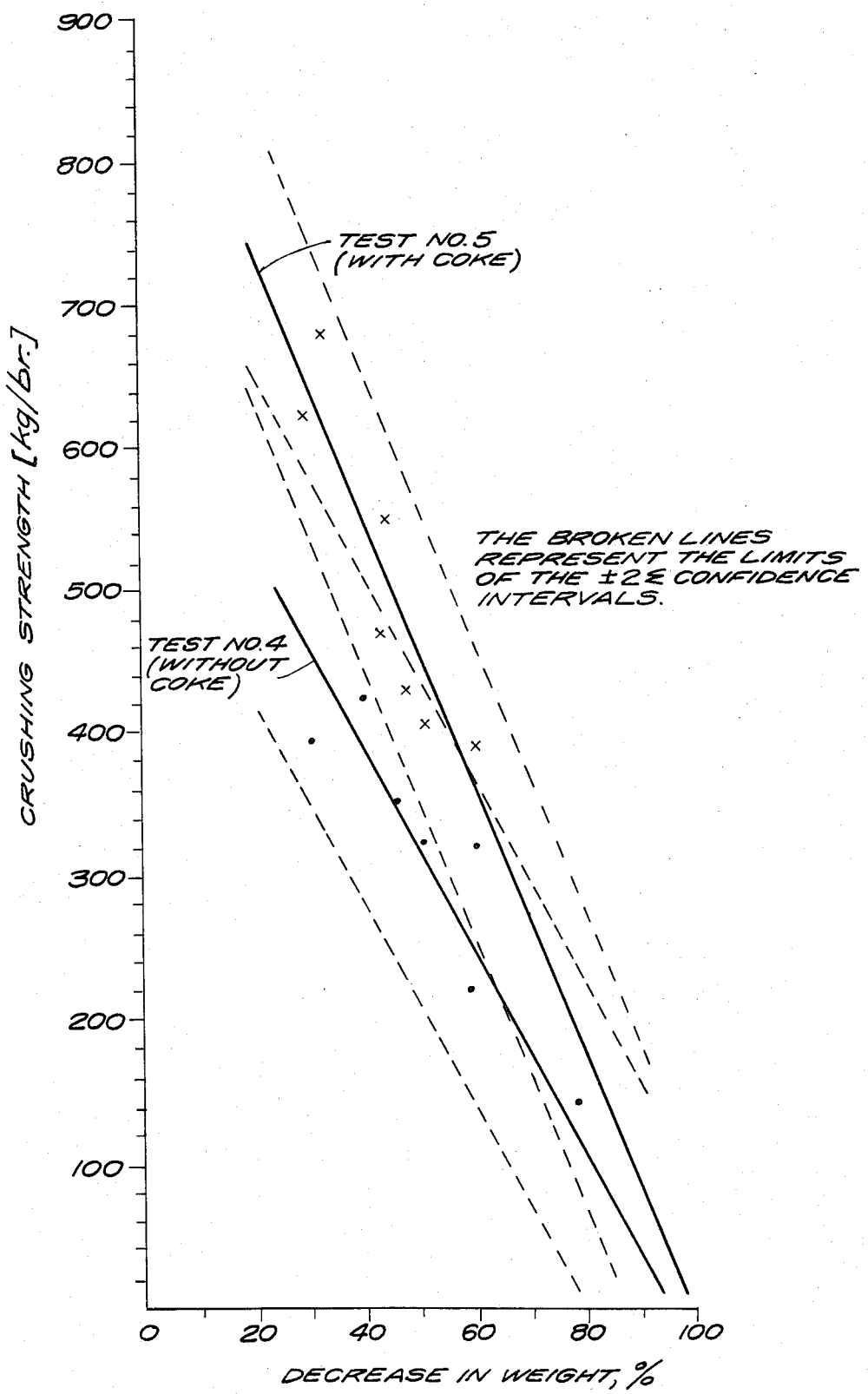
900
800
700
600
500
400
300
200
100
CRUSHING STRENGTH [kg/br.]
TEST NO.5 (WITH COKE)
TEST NO.4 (WITHOUT COKE)
THE BROKEN LINES REPRESENT THE LIMITS OF THE ±2Σ CONFIDENCE INTERVALS.
0
20
40
60
80
100
DECREASE IN WEIGHT, %

PROCESS OF PRODUCING BRIQUETTES TO BE CHARGED TO ZINC-PRODUCING SHAFT FURNACES

This is a continuation of application Ser. No. 339,583, pending filed Jan. 15, 1982.

BACKGROUND OF THE INVENTION

1. Field of the Invention

This invention relates to a process of producing briquettes to be charged to zinc-producing shaft furnaces, in which process calcined material, which has been obtained by roasting in a fluidized bed and contains zinc oxide is subjected to hot briquetting.

2. Discussion of Prior Art

For the production of zinc in a shaft furnace, the sulfidic ore concentrates must be roasted and formed into lumps. Roasting by sintering on a traveling grate is rather expensive and the resulting exhaust gas has a relatively low $SO_2$ content. Additionally, that operation gives rise to problems relating to pollution of the environment. These problems can be avoided to a large extent by a roasting in a fluidized bed. However, the resulting fine-grained calcined material, hereinafter referred to as a "calcine", must be formed into lumps in a separate process step.

It is known from British Pat. No. 1,302,864 to form calcine obtained by roasting in a fluidized bed into briquettes at temperatures of at least 500° C. and under a pressure of 0.157 to 3.15 metric tons per $cm^2$ without addition of carbonaceous binders. However, the resulting material can be reduced much less easily than sintered material.

German 23 60 346 discloses the production of briquettes which incorporate bonded fine-grained coke. However, only fine-grained zinc oxide and, if desired, fine-grained lead oxide, which may have been obtained by the Waelz process, can be processed in that manner. That pulverulent material must first be formed into pellets, which are 2 to 10 mm in diameter and subsequently briquetted at 500° to 800° C. Pelletizing constitutes an additional operation and the pellets must be dried before they are briquetted because the briquettes would otherwise burst. This drying is also required since moisture is not desired in the zinc-producing shaft furnace as it tends to re-oxidize the zinc vapor.

From V. Tafel, Lehrbuch der Metallhüttenkunde 1953, Volume II, pages 518–519, it is known to obtain charge material for a recovery of zinc in a vertical retort furnace in that calcine is briquetted together with caking coal and a binder and to coke the briquettes before they are charged to the retort furnaces. It is also known to briquette ores or oxides together with caking coal or bituminous binders, which are heated to a plastic consistency (German 12 52 623; German Offenlegungsschrift 23 35 669; German 718,967; U.S. Pat. No. 3,212,877). That process requires a separate coking step and expulsion of volatile constituents may result in cracking and bursting of the briquettes.

It is an object of the invention to provide an inexpensive process for the treatment of calcine obtained by roasting in a fluidized bed so as to form briquettes which have desirable properties for the production of zinc in a shaft furnace.

SUMMARY OF INVENTION

This object is accomplished in accordance with the invention in that the calcine is provided with a content of metallic lead and/or lead oxide corresponding to at least 3% lead, non-caking coal having a low content of volatile constituents is admixed to the calcine, a Pb:C weight ratio of at least 1 is adjusted, and the mixture is briquetted at a compacting temperature of 250° to 470° C. and under an applied pressure amounting to 4 to 20 metric tons per centimeter of the width of the rolls when said pressure is dynamically measured.

The calcine which becomes available as it is discharged from the fluidized bed or from a cyclone or other dust-collecting plant has a wide particle size range of about >0 to 5 mm. A predominant portion has a particle size below 2 mm. The calcines from various sources can thoroughly blended. The metallic lead and/or lead oxide which is admixed is generally obtained from the zinc-producing shaft furnace and may consist, e.g., of dross from the pump sump of the condenser or of dust collected from the ambient indoor atmosphere or of filter sludge obtained from a fluid used to scrub gas. The materials which contain the metallic lead and/or lead oxide are also used in a particle size of about 0 to 5 mm. Metallic lead and/or lead oxide may be added in an amount corresponding to about 15% by weight of lead. The non-caking coals may contain up to about 6% by weight of volatile constituents, such as fine-grained coke and anthracite. The compacting at temperatures in the upper part of the stated range will result in stronger briquettes. The same result is obtained with higher applied pressures, which are measured dynamically, during the operation of the press.

In accordance with a preferred further feature the mixture to be briquetted has a lead content of 3 to 12% by weight in the form of elemental lead or lead oxide, a carbon content of 2 to 6% by weight and a Pb:C weight ratio of 1.5 to 2 Briquettes having particularly good properties are obtained with these composition ranges.

EXAMPLES

The invention will be explained more in detail with reference to Examples.

EXAMPLE 1

A zinc blend having the following composition by weight and particle size distribution was roasted in a fluidized-bed pilot plant:

47.7% Zn
1.75% Pb
11.5% Fe
31.8% S
98.4% <2.000 mm
88.4% <0.045 mm

The calcine consisted of a mixture of calcines discharged from the fluidized bed and from cyclones and had the following particle size distribution:

98.2% <2.000 mm
39.1% <0.045 mm
5.0% <0.016 mm

The calcine was mixed at elevated temperature with recycled fines from the briquetting operation (2 to 8 mm) and, if desired, with lead-containing material recycled from zinc-producing shaft furnace (40% Zn, 30% Pb, 100% <3 mm) and/or with recycled materials and fine-grained coke (2.9% volatile constituents, 100% <0.5 mm) and in the same heat was briquetted in a double-roll pilot press (diameter 500 mm, width 44 mm).

| Experiment No. | 3 | 4 | 5 | 6 |
|---|---|---|---|---|
| Briquetting temperature, °C. | 300 | 300 | 350 | 390 |
| Briquetting pressure, metric tons per cm | 16 | 17 | 17.5 | 18.5 |
| Calcine % by weight | 82.7 | 73.2 | 74.0 | 68.8 |
| Recycled fines, % by weight | 17.3 | 10.7 | 9.5 | 8.9 |
| Lead-containing recycled material, % by weight | — | 16.1 | 13.0 | 15.8 |
| Coke, % by weight | — | — | 3.5 | 6.5 |
| Chemical composition of briquettes | | | | |
| Zn, % by weight | 56.7 | 54.2 | 53.8 | 51.5 |
| Pb, % by weight | 2.3 | 6.7 | 5.6 | 7.5 |
| C, % by weight | 0.02 | 0.59 | 2.9 | 4.85 |
| S, % by weight | 1.64 | 0.7 | 1.7 | 1.7 |
| Pb:C weight ratio | — | — | 1.93 | 1.55 |
| Output, briquettes per hour | 9747 | 8400 | 10407 | 10407 |
| Density of briquettes, g/cm$^3$(+) | 4.08 ± 0.08 | 4.22 ± 0.10 | 3.69 ± 0.12 | 3.73 ± 0.12 |
| Cold-crushing strength N/briquette(+) | 1472 ± 243 | 2950 ± 223 | 1211 ± 157 | 774 ± 117 |
| Drop test, cold, 2 m | | | | |
| % intact after 1st fall | 51 | 92 | 75 | 60 |
| % intact after 2nd fall | 28 | 88 | 50 | 32 |
| % intact after 3rd fall | 18 | 85 | 28 | 20 |

(+)The confidence interval (measuring error) amounted to 2 sigma

EXAMPLE 2

The calcine was used for two briquetting experiments without admixtures but under different experimental conditions.

| | Experiment No. 1 | Experiment No. 2 |
|---|---|---|
| Temperature in holding container, °C. | 590 | 400 |
| Briquetting temperature, °C. | 320 | 235 |
| Hydraulic pressure, bars | 200 | 170 |
| Zn, % by weight | 57.6–58 | 56.6 |
| Pb, % by weight | 2.2–2.3 | 2.0 |
| C, % by weight | 0.02–0.03 | 0.03 |
| Total S (bed), % by weight | 1.0–1.5 | 1.3 |

It is apparent that briquetting was effected under distinctly more favorable conditions in Experiment No. 1. This is reflected by the qualities of the briquettes and the briquetting rate:

| | Experiment No. 1 | Experiment No. 2 |
|---|---|---|
| Weight of briquette, g(+) | 39.9 ± 1.3 | 35.6 ± 0.8 |
| Density of briquettes, g/cm$^3$(+) | 4.39 ± 0.11 | 3.75 ± 0.15 |
| Initial porosity, % | 0 | 12.2 |
| Cold-crushing strength, N/briquette+ | 2729 ± 197 | 1339 ± 243 |
| Drop test (2 m) | | |
| Intact after 1st fall, % | 57 | 52 |
| Intact after 2nd fall, % | 30 | 25 |
| Intact after 3rd fall, % | 25 | 12 |
| Briquetting rate, metric tons per hour | 0.39 | 0.28 |

EXAMPLE 3

Ten briquettes from Experiments 4 and 5 were tested.

| | Experiment No. 4 | Experiment No. 5 |
|---|---|---|
| Calcine, % by weight | 73.2 | 74.0 |
| Recycled fines, % by weight | 10.7 | 9.5 |
| Lead-containing recycled material, % by weight | 16.1 | 13.0 |
| Coke, % by weight | 0 | 3.5 |
| Zn, % by weight | 54.2 | 53.8 |
| Pb, % by weight | 6.7 | 5.6 |
| C, % by weight | 0.6 | 2.9 |
| Reduction time, hours | 2 | 0.5 |
| Relative weight loss, % | | |
| Minimum | 31.9 | 31.0 |
| Maximum | 84.0 | 62.1 |
| Cold-crushing strength after reduction N/briquette | | |
| Maximum | 4168 | 6669 |
| Minimum | 177 | 3825 |

The strength after a partial reduction is shown on the drawing.

The advantages afforded by the invention reside in that the briquettes have a high initial reducibility so that they have a high total reducibility in a relatively short time, that they have a high and adequate mechanical strength and can be produced at low cost and that briquetting can be effected without a reheating of the material discharged from the fluidized bed.

What is claimed is:

1. In a process of producing briquettes to be charged to a zinc producing shaft furnace, wherein a calcine which has been obtained by roasting in a fluidized bed and contains zinc oxide is subjected to hot briquetting, the improvement wherein the calcine has a content of metallic/lead and/or lead oxide corresponding to at least 3% lead, a content of 2 to 6 percent by weight coal consisting essentially of non-caking coal which has a low content of volatile constituents of up to 6 percent, a Pb:C mixture weight ratio of at least 1, and the mixture is briquetted at a compacting temperature of 250° to 470° C. and under an applied pressure amounting to 4 to 20 metric tons per centimeter of the width of the rolls when pressure is dynamically measured.

2. A process according to claim 1, wherein the mixture to be briquetted has a lead content of 3 to 12% by weight, and a Pb:C weight ratio of 1.5 to 2.

3. A process according to claim 2, wherein a portion of the lead or lead oxide content of said calcine is obtained from a dross from a pump sump of a condenser or of a dust collected from indoor ambient atmosphere or from sludge obtained from a fluid used to scrub gas.

4. A process according to claim 2, wherein at least a portion of the lead or lead oxide of said calcine has a particle size of >0 to 5 mm.

5. A process according to claim 1, wherein after said briquettes are formed they are introduced to a zinc shaft furnace and therein the zinc is separated from the lead.

6. A process according to claim 5, wherein zinc is separated from lead by being distilled off and lead is withdrawn from the bottom of the zinc shaft furnace.

7. Briquettes produced by the process of claim 1.

* * * * *

UNITED STATES PATENT AND TRADEMARK OFFICE

CERTIFICATE OF CORRECTION

PATENT NO. : 4,525,207

DATED : June 25, 1985

INVENTOR(S) : Dirk Hankel

It is certified that error appears in the above-identified patent and that said Letters Patent is hereby corrected as shown below:

| | |
|---|---|
| Col. 1, lines 6, 7 | After "Ser. No. 339,583," delete "pending" and substitute --abandoned-- |

Signed and Sealed this

*Eleventh* Day of *February 1986*

[SEAL]

*Attest:*

DONALD J. QUIGG

*Attesting Officer*

*Commissioner of Patents and Trademarks*